US008152557B2

(12) United States Patent
Blanton et al.

(10) Patent No.: US 8,152,557 B2
(45) Date of Patent: Apr. 10, 2012

(54) POSITIVE LOCKING MECHANISM FOR USB CONNECTED DEVICES

(75) Inventors: Robin Blanton, Grosse Ile, MI (US); Roger Leon Van Elslander, Warren, MI (US)

(73) Assignee: Dearborn Group Technology, Farmington Hills, MI (US)

( * ) Notice: Subject to any disclaimer, the term of this patent is extended or adjusted under 35 U.S.C. 154(b) by 17 days.

(21) Appl. No.: 12/218,706

(22) Filed: Jul. 17, 2008

(65) Prior Publication Data

US 2010/0015838 A1 Jan. 21, 2010

(51) Int. Cl.
*H01R 13/627* (2006.01)

(52) U.S. Cl. ..... 439/362

(58) Field of Classification Search ..... 439/362, 439/358, 484, 573; 361/752; 174/547, 562
See application file for complete search history.

(56) References Cited

U.S. PATENT DOCUMENTS

| | | | | | |
|---|---|---|---|---|---|
| 4,717,299 | A | * | 1/1988 | Underwood | 411/11 |
| 4,958,970 | A | * | 9/1990 | Rose et al. | 411/12 |
| 5,065,282 | A | * | 11/1991 | Polonio | 361/752 |
| 5,342,216 | A | * | 8/1994 | Davis et al. | 439/362 |
| 5,725,387 | A | * | 3/1998 | O'Sullivan et al. | 439/98 |
| D496,632 | S | * | 9/2004 | David et al. | D13/147 |
| D515,036 | S | * | 2/2006 | Liang | D13/147 |
| 2008/0254681 | A1 | * | 10/2008 | O'Hanlan | 439/607 |

* cited by examiner

*Primary Examiner* — Alexander Gilman
(74) *Attorney, Agent, or Firm* — Warn Partners, P.C.

(57) ABSTRACT

The present invention is a positive locking mechanism for a universal serial bus (USB) connector which includes at least one mounting portion connected to the USB connector with the mounting portion having an aperture. The present invention also includes at least one flange in proximity to the mounting portion, with the flange having an aperture, as well as a fastener inserted through the aperture of the flange and the aperture of the mounting portion, where the fastener is used to connect the mounting portion to a structure.

6 Claims, 2 Drawing Sheets

POSITIVE LOCKING MECHANISM FOR USB CONNECTED DEVICES

FIELD OF THE INVENTION

The present invention relates to universal serial bus (USB) connectors. More particularly, the present invention relates to a positive locking mechanism for a USB connector for securing a USB connector to a device used for communicating with a computer.

BACKGROUND OF THE INVENTION

USB connectors and cables are generally known. There are two common types of USB connectors. One type of connector is called an "A connector," and the other type of connector is what is referred to as a "B type connector." The first type of connector, an A connector, is used for heading "upstream" toward the computer, and the second type of connector, the B connector, heads "downstream" and connects to an individual device used for communicating with the computer. These types of connectors are used to allow various external devices, such as printers, scanners, fax machines, keyboards, a mouse, a personal digital assistant (PDA), and other devices to communicate with the computer. To connect the USB cable to the device and the computer, each connector of the USB cable simply plugs in to a corresponding port on the computer or the device. However, with typical USB connectors, there is no locking mechanism used for securing the connection between the connector and the connector's corresponding port. Therefore, certain types of handheld devices, such as PDAs or diagnostic tools, which are used and moved around quite frequently, can become inadvertently disconnected from the USB connector.

Therefore, there exists a need for an improved USB connector which can be secured to a device that is used to communicate with a computer.

SUMMARY OF THE INVENTION

The present invention is a positive locking mechanism for a universal serial bus (USB) connector which includes at least one mounting portion connected to the USB connector, with the mounting portion having an aperture. The present invention also includes at least one flange in proximity to the mounting portion, with the flange having an aperture, as well as a fastener, inserted through the aperture of the flange and the aperture of the mounting portion, where the fastener is used to connect the mounting portion to a structure.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1A:
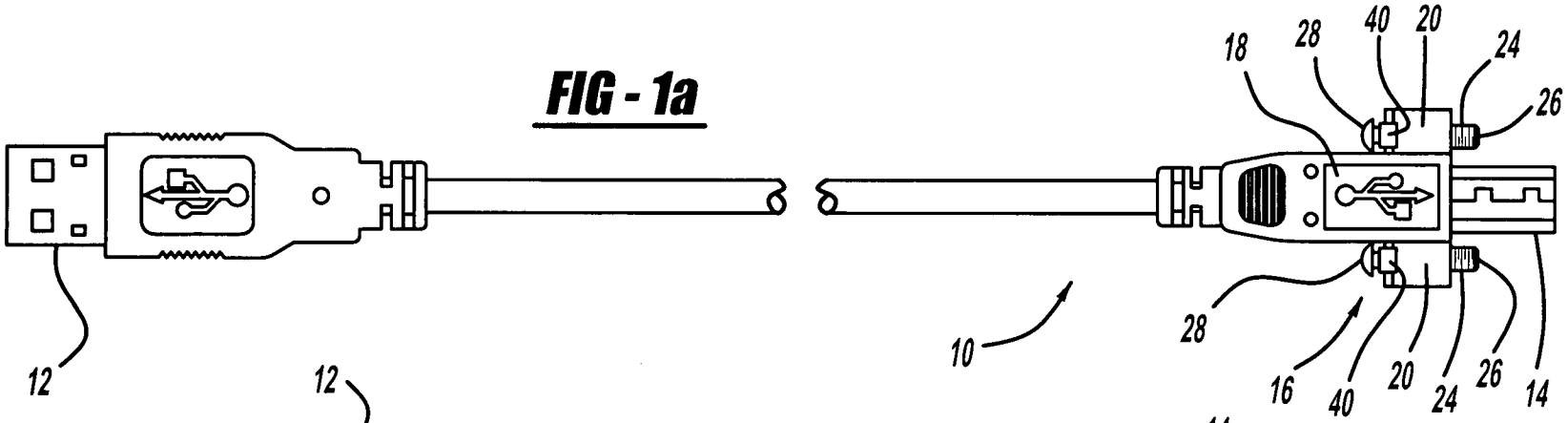
FIG. 1*a* is a top view of a USB cable having a connector incorporating a positive locking mechanism, according to the present invention.
Figure 1C:
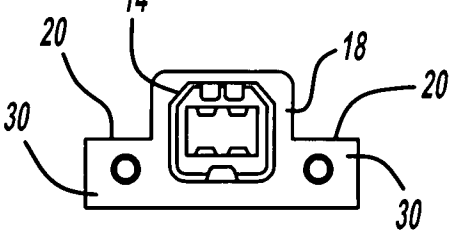
FIG. 1*c* is a front view of a USB connector incorporating a positive locking mechanism, according to the present invention.
Figure 1B:
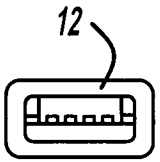
FIG. 1*b* is a front view of a USB connector, connected to a cable which incorporates a USB connector having a positive locking mechanism, according to the present invention.
Figure 2:
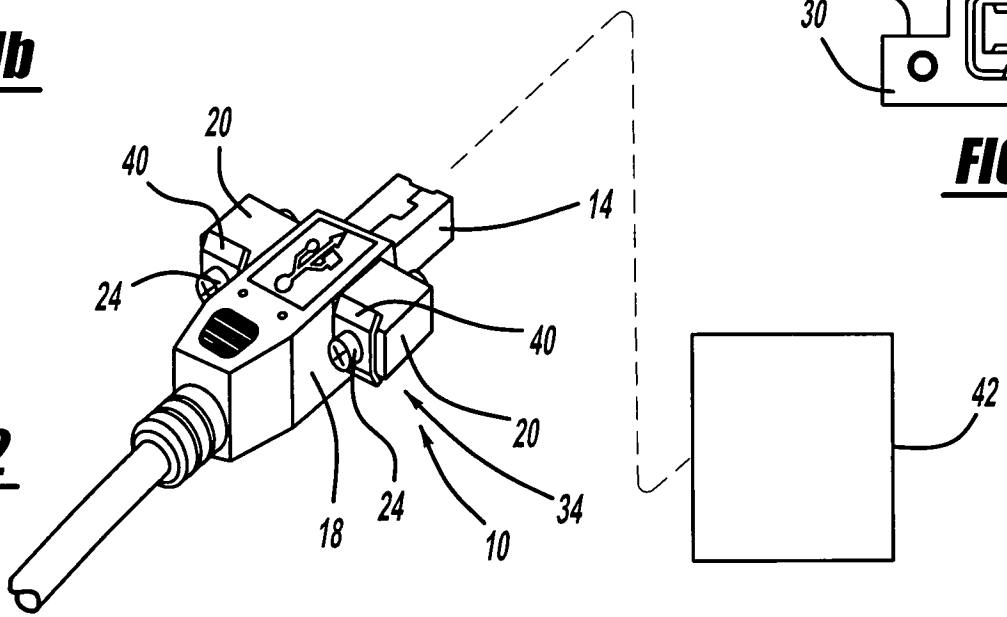
FIG. 2 is a perspective view of a USB connector incorporating a positive locking mechanism, according to the present invention.

The following description of the preferred embodiment(s) is merely exemplary in nature and is in no way intended to limit the invention, its application, or uses.

A universal serial bus (USB) connector cable incorporating a positive locking mechanism according to the present invention is shown in the Figures generally at 10. The cable 10 includes two different types of standard connectors, the standard "A connector" 12, and the standard "B connector" 14, with the exception that a positive locking mechanism, according to the present invention and generally shown at 16, is incorporated into the B connector 14. The A connector is typically connected to a computer (not shown) and the B connector 14 is typically connected to a device (not shown) which is used for communicating with the computer.

The operation of the USB cable 10 is similar any other standard USB cable, and therefore is not described herein. The B connector 14 includes a protective molding 18. A portion of the molding 18 is part of the positive locking mechanism 16. Formed in the molding 18 is a mounting portion in the form of a pair of mounting blocks 20, which are part of the positive locking mechanism 16. Each of the mounting blocks 20 has an aperture 22 which extends through each of the mounting blocks 20. The positive locking mechanism 16 also includes a fastener, such as a bolt 24, which extends through each of the apertures 22; each bolt 24 has a threaded portion 26 and a head portion 28. Each of the mounting blocks 20 also includes a first mounting face 30 and a second mounting face 32.

Figure 3:
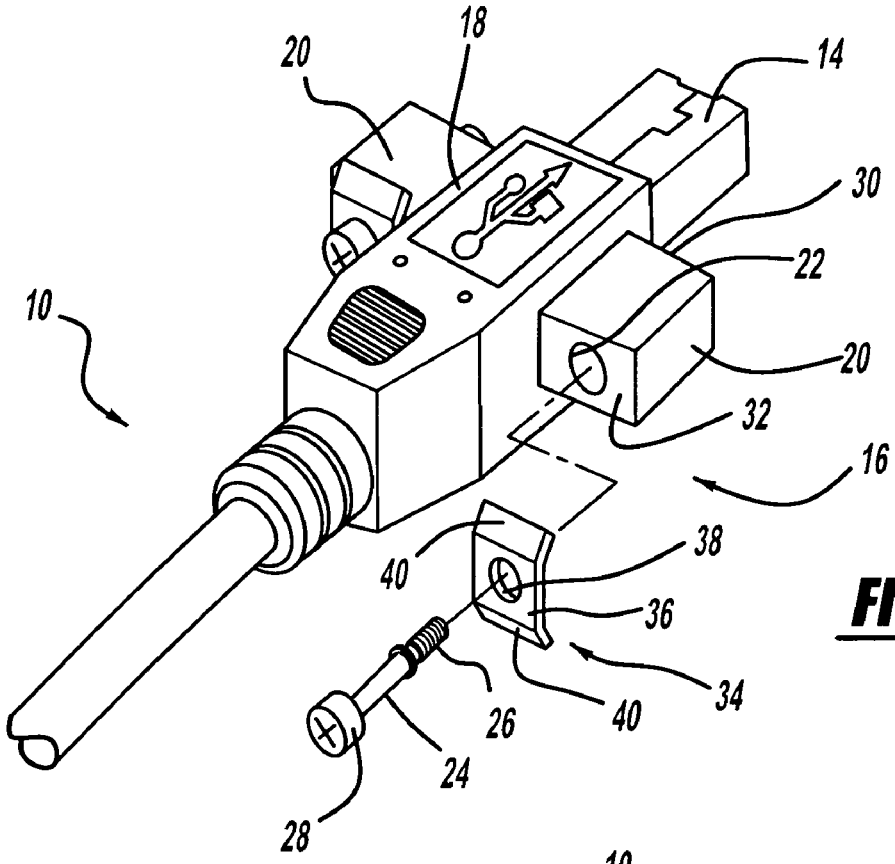
FIG. 3 is a partially exploded view of a USB connector incorporating a positive locking mechanism, according to the present invention.
Figure 4:
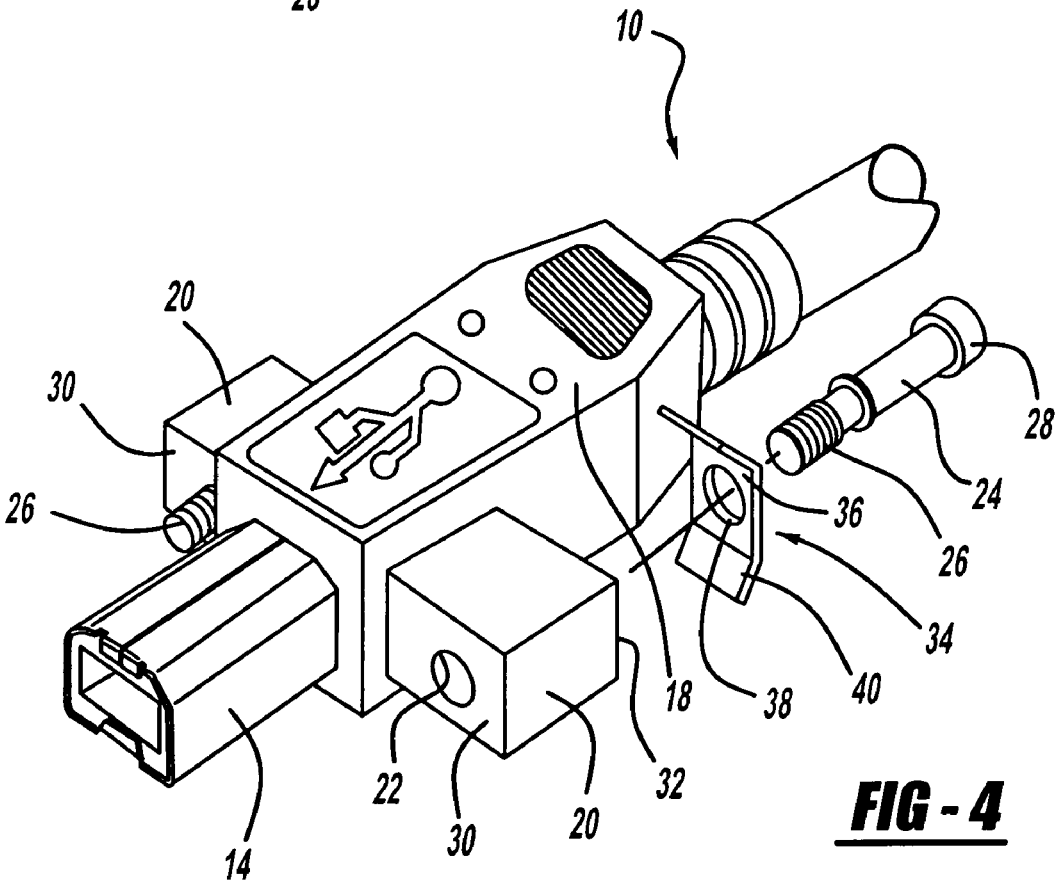
FIG. 4 is a second exploded view of a USB connector incorporating a positive locking mechanism, according to the present invention.

Also included in the positive locking mechanism 16 are a pair of flanges, shown generally at 34, each of the flanges 34 includes a flat portion 36 which has an aperture 38 through which each of the bolts 24 extend, as shown in FIGS. 3 and 4. Each of the flanges 34 also includes two angled portions 40. The flat portions 36 of the flanges 34 serve the purpose of distributing the load applied from the bolts 24 as they are tightened (the purpose of which will be described later).

When the USB cable 10 is to be attached to a device for use, the A connector 12 is plugged into a computer and the B connector 14 is plugged into a device which will be used to communicate with the computer, such as a diagnostic tool, shown schematically at 42. Once the B connector 14 is attached, the bolts 24 will be screwed into a corresponding threaded aperture (not shown) attached the device such that a tension force is applied to the bolt 24, thereby fixedly mounting the B connector 14 to the device. The bolts 24 are tightened so each of the first mounting faces 30 is in contact with the device the B connector 14 is to be connected to, and each of the second mounting faces 32 is in contact with the flat portion 36. The tension force from the bolts 24 being attached to the device is transferred through the flat portions 36 of the flanges 34 and to the mounting blocks 20, thereby applying a compressive force to the mounting blocks 20. The flat portions 36 of the flanges 34 aid in disbursing the tension load onto the mounting blocks 20 from the bolt 24, this prevents the heads 28 of the bolts 24 from being forced into the apertures 22 of the mounting blocks 20 when the bolts 24 are under load.

The threaded portion 26 of the bolt 24 does not extend the entire length of the bolt 24. The threaded portion 26 is limited to the area of the bolt 24 which is received into the threaded aperture of the device the B connector 14 is connected to. The remaining portion of the bolt 24 that is not threaded is disposed within the apertures 22 of each of the mounting blocks 20.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A positive locking mechanism for a universal serial bus (USB) connector used with a handheld diagnostic tool, comprising:

a handheld diagnostic tool having a USB port;

a first mounting block formed as a portion of said USB connector, said first mounting block having an aperture, a first mounting face, and a second mounting face;

a second mounting block formed as a portion of said USB connector on the opposite side of said USB connector in relation to said first mounting block, said second mounting block having an aperture, a first mounting face, and a second mounting face;

a first flange adjacent said first mounting block;

a substantially flat portion formed as part of said first flange and in contact with said first mounting block, said substantially flat portion having an aperture, said aperture of said first flange is substantially aligned with said aperture of said first mounting block;

a second flange adjacent said second mounting block;

a substantially flat portion formed as part of said second flange and in contact with said second mounting block, said substantially flat portion having an aperture, said aperture of said second flange is substantially aligned with said aperture of said second mounting block;

at least one angled portion connected to said substantially flat portion formed as part of said first flange;

at least one angled portion connected to said substantially flat portion formed as part of said second flange;

a plurality of fasteners, at least one of said plurality of fasteners is inserted through said aperture of said substantially flat portion of said first flange and said aperture of said first mounting block, and another of said plurality of fasteners is inserted through said aperture of said substantially flat portion of said second flange and said aperture of said second mounting block;

said handheld diagnostic tool connected to said mounting portion through the use of said plurality of fasteners;

at least one aperture for receiving one of said plurality of fasteners, said at least one aperture formed as a portion of said handheld diagnostic tool; and a threaded portion formed in said at least one aperture formed as a portion of said handheld diagnostic tool; and a threaded portion formed on a portion of each of said plurality of fasteners such that when said one of said plurality of fasteners is received by said at least one aperture formed as a portion of said handheld diagnostic tool, said threaded portion of said one of said plurality of fasteners is engaged with said threaded portion formed in said at least one aperture formed as a portion of said handheld diagnostic tool, and said USB connector is fixedly connected to said handheld diagnostic tool, forming a USB connection;

wherein said USB connection is maintained during operation and movement of said handheld diagnostic tool.

2. The positive locking mechanism for a USB connector used with a handheld diagnostic tool of claim 1, wherein one of said series of fasteners extending through said aperture of said first flange and said aperture of said first mounting block is received by said handheld diagnostic tool such that said first mounting face of said first mounting block is adjacent said handheld diagnostic tool, and said second mounting face of said first mounting block is adjacent said first flange, and another of said series of fasteners extending through said aperture of said second flange and said aperture of said second mounting block is received by said handheld diagnostic tool such that said first mounting face of said second mounting block is adjacent said handheld diagnostic tool, and said second mounting face of said second mounting block is adjacent said second flange.

3. A positive locking mechanism for a universal serial bus (USB) connector used with a handheld diagnostic tool, comprising:

a handheld diagnostic tool having a USB port;

a first mounting block having an aperture, a first mounting face, and a second mounting face, said first mounting block formed as a portion of a USB connector;

a second mounting block having an aperture, a first mounting face, and a second mounting face, said second mounting block formed as a portion of said USB connector;

a first flange having a substantially flat portion, at least one angled portion connected to said substantially flat portion, and an aperture formed as a portion of said substantially flat portion, said first flange in contact with said second mounting face of said first mounting block, wherein the angled portion positions the flange on the mounting block;

a second flange having a substantially flat portion, at least one angled portion connected to said substantially flat portion, and an aperture formed as a portion of said substantially flat portion, said second flange in contact with said second mounting face of said second mounting block, wherein the angled portion positions the flange on the mounting block;

said handheld diagnostic tool selectively connected to said first mounting block and said second mounting block;

a plurality of fasteners, one of said plurality of fasteners extending through said aperture of said first mounting block and said aperture of said substantially flat portion of said first flange into said handheld diagnostic tool, and another of said plurality of fasteners extending through said aperture of said second mounting block and said aperture of said substantially flat portion of said second flange into said handheld diagnostic tool;

a threaded portion formed as part of each of said plurality of fasteners;

a plurality of apertures for receiving said plurality of fasteners, said plurality of apertures formed as part of said handheld diagnostic tool; and a threaded portion formed in each of said plurality of apertures for engaging with said threaded portion of each of said plurality of fasteners;

wherein said USB connection is maintained during operation and movement of said handheld diagnostic tool.

4. The positive locking mechanism for a universal serial bus (USB) connector used with a handheld diagnostic tool of claim 3, wherein said first mounting face of said first mounting block contacts said handheld diagnostic tool and said second mounting face of said first mounting block contacts said first flange when one of said plurality of fasteners extending through said aperture of said first mounting block and said aperture of said first flange is connected to said handheld diagnostic tool, and said first mounting face of said second mounting block contacts said handheld diagnostic tool and said second mounting face of said second mounting block contacts said second flange when one of said plurality of fasteners extending through said aperture of said second mounting block and said aperture of said second flange is connected to said handheld diagnostic tool.

5. A positive locking mechanism for a universal serial bus (USB) connector used with a handheld diagnostic tool, comprising:

a handheld diagnostic tool having a USB port;

a first mounting block formed as a portion of a USB connector, said first mounting block having a first mounting face and a second mounting face;

an aperture formed as a portion of said first mounting block;

a second mounting block formed as a portion of said USB connector, said second mounting block having a first mounting face and a second mounting face;

an aperture formed as a portion of said second mounting block;

a first flange having a substantially flat portion, at least one angled portion connected to said substantially flat portion, and an aperture formed as a portion of said substantially flat portion, said aperture of said first flange adjacent said second mounting face of said first mounting block, wherein the angled portion positions the flange on the mounting block;

a second flange having a substantially flat portion, at least one angled portion connected to said substantially flat portion, and an aperture formed as a portion of said substantially flat portion, said aperture of said second flange adjacent said second mounting flange of said second mounting block, wherein the angled portion positions the flange on the mounting block; and a plurality of fasteners, one of said plurality of fasteners extending through said aperture of said first mounting block and said aperture of said first flange, and another of said fasteners extending through said aperture of said second mounting block and said aperture of said second flange;

a plurality of threaded apertures formed as part of said handheld diagnostic tool, said threaded apertures for receiving said plurality of fasteners, wherein one of said plurality of fasteners extending through said aperture of said first mounting block and said aperture of said substantially flat portion of said first flange is received by one of said plurality of threaded apertures such that said first mounting face of said first mounting block is in proximity to said handheld diagnostic tool, and another of said plurality of fasteners extending through said aperture of said second mounting block and said aperture of said substantially flat portion of said second flange is received by one of said plurality of threaded apertures such that said first mounting face of said second mounting block is in proximity to said handheld diagnostic tool, wherein said USB connection is maintained during operation and movement of said handheld diagnostic tool.

6. The positive locking mechanism for a USB connector used with a handheld diagnostic tool of claim 5, each of said plurality of fasteners further comprising:

a threaded portion which is received by one of said plurality of threaded apertures of said handheld diagnostic tool; and a head portion connected to said threaded portion.

* * * * *